US006254908B1

(12) United States Patent
Winters

(10) Patent No.: US 6,254,908 B1
(45) **Date of Patent: *Jul. 3, 2001**

(54) PACKAGING SYSTEM FOR VENTABLE BAGS

(75) Inventor: Nicholas H. Winters, Suffern, NY (US)

(73) Assignee: Kraft Foods, Inc., Northfield, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/326,890

(22) Filed: Jun. 7, 1999

(51) Int. Cl.[7] ..... B65D 81/00; B65D 85/00

(52) U.S. Cl. ..... 426/118; 426/106; 426/124; 426/108; 206/521; 206/592

(58) Field of Search ..... 426/124, 398, 426/411, 106, 118, 395, 108, 404; 206/521, 592, 526; 229/120.02, 120.06, 120.23, 120.35, 120.38

(56) References Cited

U.S. PATENT DOCUMENTS

| | | | | |
|---|---|---|---|---|
| 1,108,405 | | 8/1914 | Shunk . | |
| 2,348,509 | * | 5/1944 | Wheeler | 426/108 |
| 2,382,308 | | 8/1945 | Gevaart | 229/14 |
| 3,695,505 | | 10/1972 | Wolf | 229/37 |
| 4,000,846 | | 1/1977 | Gilbert | 229/62.5 |
| 4,184,625 | | 1/1980 | Stollberg et al. | 229/23 |
| 4,437,569 | | 3/1984 | Sorenson | 206/601 |
| 5,515,994 | | 5/1996 | Goglio | 220/372 |
| 5,553,709 | | 9/1996 | Wharton et al. | 206/446 |

* cited by examiner

*Primary Examiner*—Milton Cano
*Assistant Examiner*—Robert Madsen
(74) *Attorney, Agent, or Firm*—Thomas A. Marcoux

(57) ABSTRACT

A packaging system for pillow bags containing coffee or other consumable products which generate gases includes a container assembly into which a triangular shaped insert is positioned to reduce the space at the top portion of the container. The insert prevents excessive swelling in the headspace of the bags and also reduces damages occurring to the bags by eliminating movement of the bags in the container during transport.

8 Claims, 3 Drawing Sheets

PACKAGING SYSTEM FOR VENTABLE BAGS

FIELD OF THE INVENTION

The present invention relates to a packaging system for ventable product containing bags equipped with degassing relief valves and, more particularly, to a packaging system in which a container assembly for shipping such bags includes a removable insert for reducing space at the top portion of the container and minimizing damage during shipping and handling of such bags.

BACKGROUND OF THE INVENTION

As an alternative to cans, products which generate gases, typically either roasted and ground coffee or roasted whole bean coffee, are often packaged in soft packages without applying a vacuum; these packages are typically known as pillow bags. Pillow bags are desirable in that they are easier to handle and more lightweight than cans and, as the product is used, the bags may be compressed to reduce the amount of space needed to store them. However, there are several drawbacks associated with pillow bags.

One problem with pillow bags is that newly packaged coffee tends to generate a mixture of gases inside the bag, mainly carbon dioxide, which causes the bag to become swollen and eventually burst, rendering the package unsellable. This problem has been ameliorated to some degree by the inclusion of a degassing valve in the bag which releases gas from the bag when a certain internal pressure is reached. The valve then closes when pressure returns to an acceptable level. Such valves are disclosed, for example, in U.S. Pat. No. 5,515,994 to Goglio and U.S. Pat. No. 4,000,846 to Gilbert. The design of these valves is typically such that the bag must completely fill with gas before sufficient internal pressure is reached to open the valve. Since such bags must necessarily have a headspace, i.e., a space within the bag above the product, and since the bags can freely expand, the headspace will fill with gas, giving it a swollen appearance by the time it is placed on the shelves of a retail store. This swollen appearance tends to be very undesirable to the consumer.

Another problem that is encountered with pillow bags is that because the bags are packaged in containers, such as rectangular boxes held closed with tape, adhesive or the like, there is a likelihood that if a knife is used to open the container, one or more bags may inadvertently be cut, rendering them unsellable. Still another problem is that since the bags are generally packaged such that they do not completely fill the container, they may bounce freely within the container during shipping and handling, causing cracks and holes to form in the bag film, allowing air to leak into the bags. The oxygen in this air causes staleness in the product long before the intended shelf-life has expired.

Accordingly, the need exists for a packaging system for ventable pillow bags containing gas generating products which reduces the amount of gas build-up in the headspace of the bags and prevents damage to the bags during shipping and handling.

SUMMARY OF THE INVENTION

Thus, it is a purpose of the present invention to provide improvements which overcome the above described disadvantages of existing packaging systems for ventable pillow bags.

In accordance with a preferred embodiment of the invention, the packaging system includes a container assembly comprising a container, an insert and the pillow bags themselves. The container is designed to receive a plurality of ventable pillow bags containing a product of the type which generates gases, each of the bags having a headspace at the top thereof which is expandable to accommodate such gases, as well as a valve for venting the gases when pressure in the bag reaches a predetermined level. The insert reduces available space in the container, thereby reducing expansion of the headspace and minimizing damage to the bags during shipping and handling.

In another preferred embodiment of the invention, a container assembly for holding a plurality of ventable bags containing a gas generating product includes a container having a bottom wall, a pair of opposite side walls, a pair of opposite end walls, an open top end and a closure member for closing the top end. The bags are receivable in the container such that the bottom ends are positioned along the bottom wall. The container assembly further includes at least one insert of triangular cross-section, said insert preferably comprising a rectangular shaped sheet of material folded to form two parallel folds therein forming the triangular shape. The insert extends generally between end walls adjacent the top of the container such that a base of the triangular shape is positioned closest to the closure member and an apex is directed downwardly to create a triangular-shaped separation between the tops of the adjacent rows of bags to thereby reduce available space at the top of the container for expansion of the headspace of the bags. Preferably the insert is removable and the container is a rectangular shaped box.

It is, therefore, an object of the present invention to provide a packaging system for pillow bags containing a gas generating product which reduces expansion of the headspace in the bags during shipping and storage.

It is another object of the invention to provide a container assembly for packaging such bags which reduces the risk of the bags being damaged when the container is opened with a knife or other sharp instrument.

It is yet another object of the invention to provide a container assembly which reduces movement of such bags packaged therein to thereby lessen the chance of damage to the bags during shipping and handling.

These and other objects of the present invention will become apparent from the detailed description to follow.

BRIEF DESCRIPTION OF THE DRAWINGS

There follows a detailed description of the preferred embodiments of the invention which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
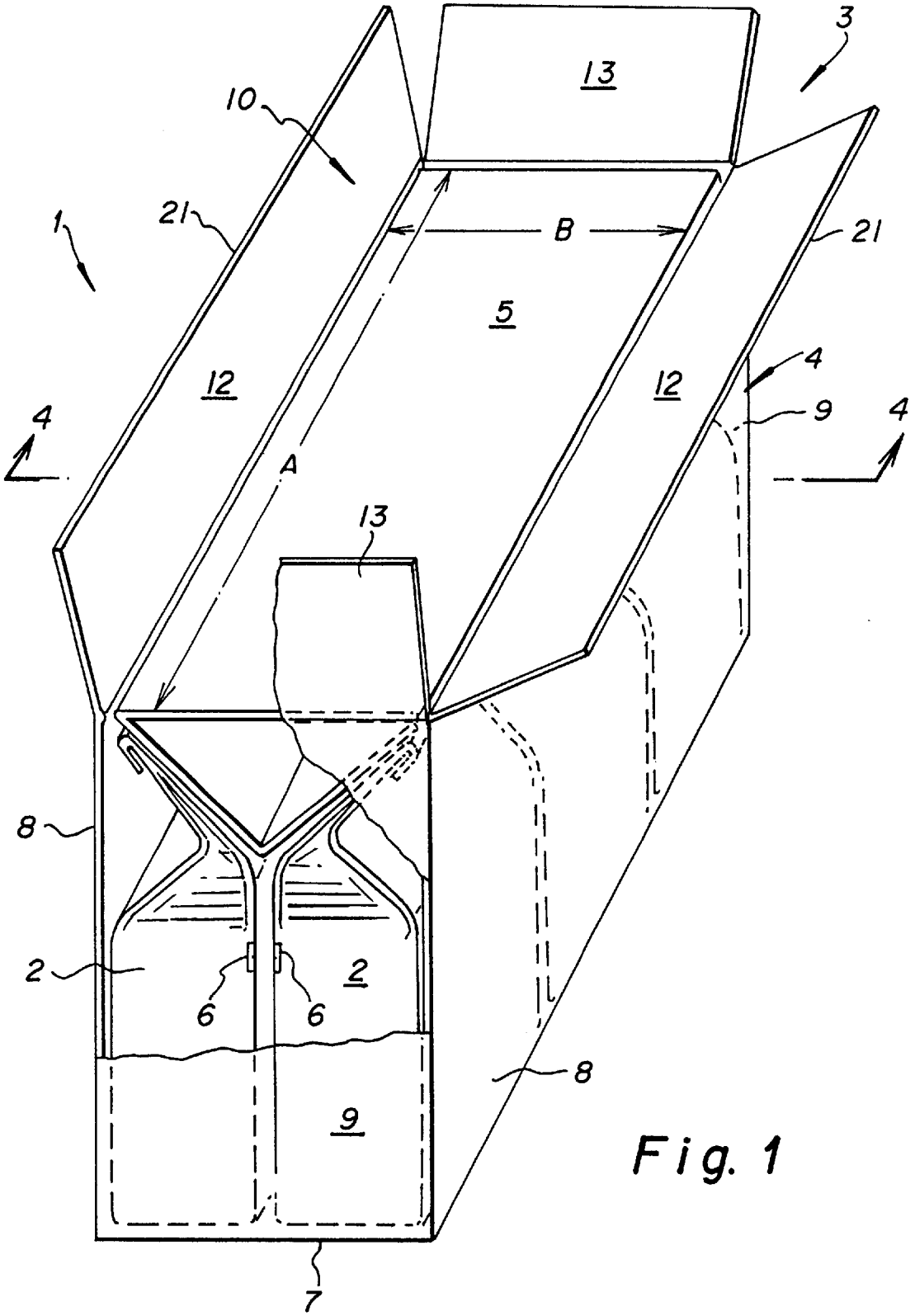
FIG. 1 is a perspective view with a partial cut away of the packaging system of the present invention.
Figure 4:
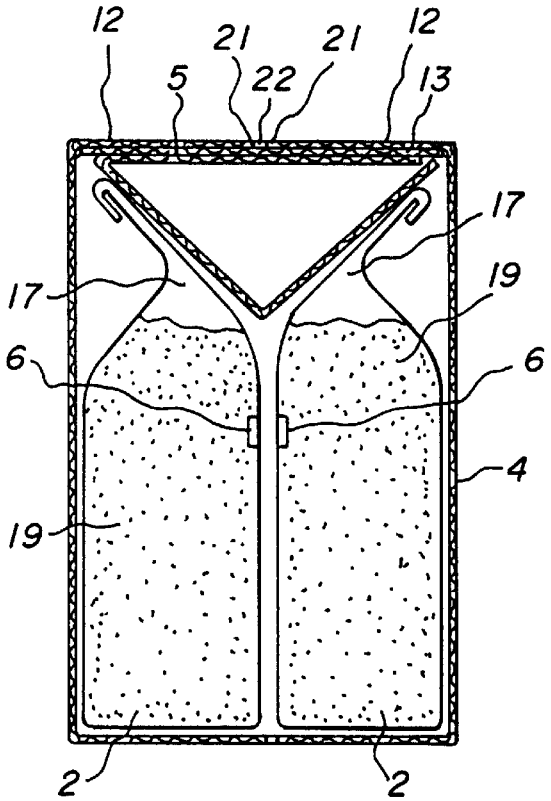
FIG. 4 is a cross-sectional view through line 4—4 of FIG. 1, but with the top of the container closed.
Figure 5:
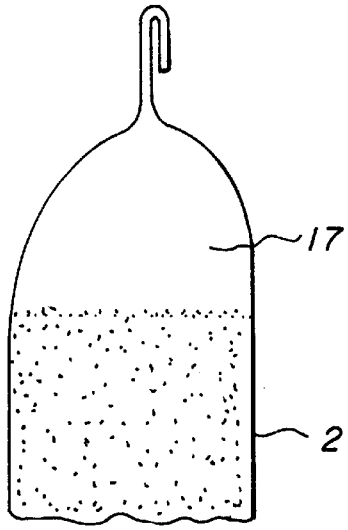
FIG. 5 shows the top of a pillow bag with a gas filled headspace.
Figure 3:
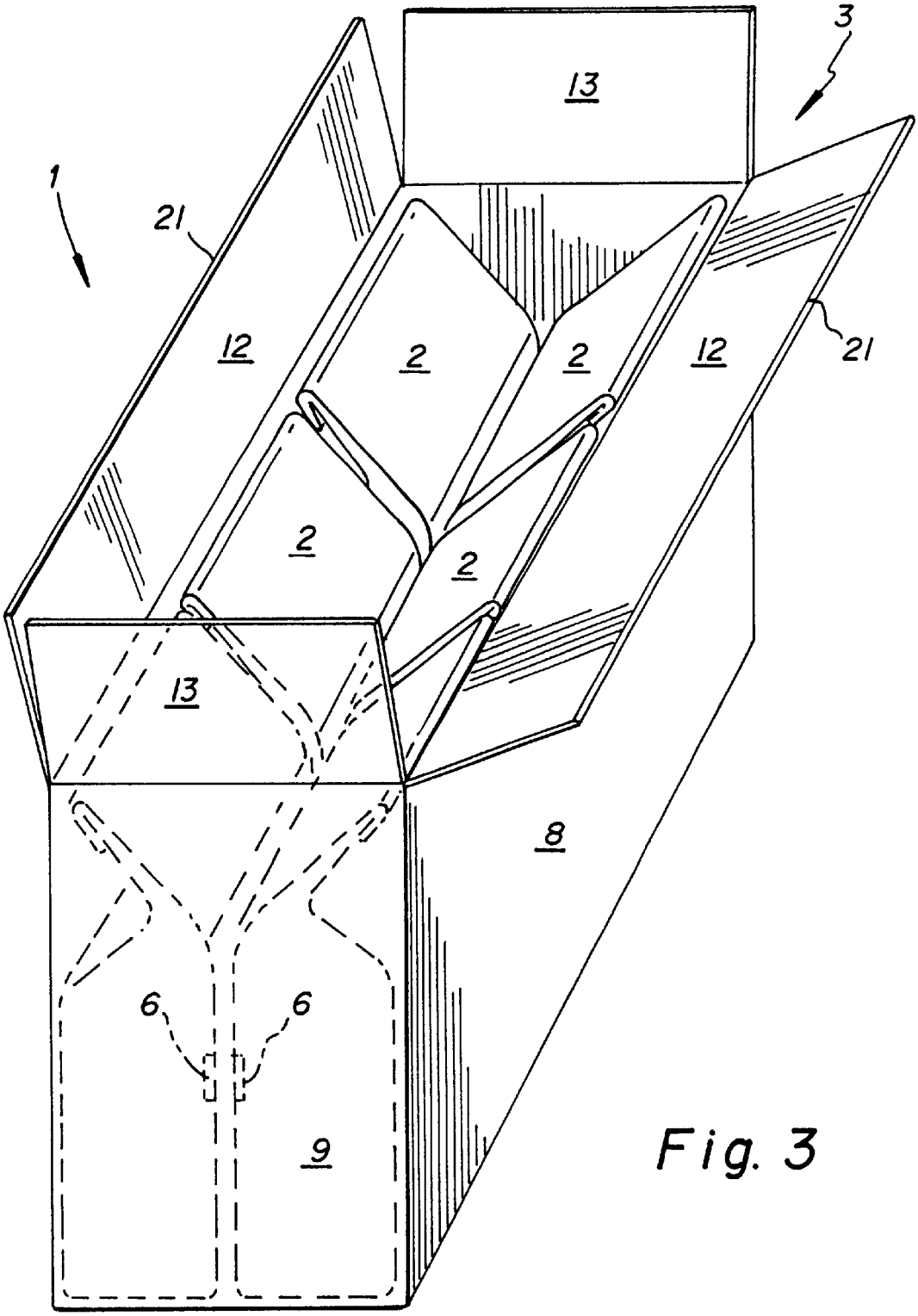
FIG. 3 is a perspective view similar to FIG. 1 but with the insert removed.

FIG. 1 shows the packaging system 1 of the invention which includes a plurality of pillow bags 2 and a container assembly 3 which includes a container 4 and an insert 5. Bags 2 contain a consumable product of the type which generates gases when packaged in a sealed, airtight container. The primary products contemplated for use with the invention are roast and ground coffee and roast whole bean coffee. After product is added to the bags 2, they are vacuumed, gas flushed and sealed at the top such that 4% or less oxygen is contained in the headspace of the bag. However any product which develops a gas during storage is within the contemplation of the invention. Initially, the headspace in the bags is minimal, with the sides of the bag close together at the top, as shown in FIGS. 1, 3 and 4. Note the small headspace 17 in FIG. 4. This is in fact the bag appearance that the customer finds most desirable. Bags 2 are fitted with degassing one way valves 6 which allow gases which develop in the bags 2 to escape when pressure in the bags 2 reaches a predetermined level. For example, where the product contained in bags 2 is coffee, carbon dioxide will typically be generated during shipping and storage. However, the valves 6 allow the gases to build up a substantial amount before venting starts. At an opposite extreme, the headspace 17 of a bag 2 could expand substantially, as shown at FIG. 5, thereby giving the bag a swollen appearance which the customer would find undesirable. Once opened, the bags may be re-closed at the top using conventional means.

Container 4 has a bottom wall 7, opposite side walls 8, opposite end walls 9, an open top 10 and a closure structure for sealing the open top 10. In the preferred embodiment, the container 4 is a rectangular shaped box constructed from corrugated paper board. Other materials of construction may also be utilized. The closure structure is generally in the form of two end flaps 13 which are first folded down and two side flaps 12 which are then folded over end flaps 13. The width of each of side flaps 12 are preferably half the width of end walls 9 such that they meet at the center line of the container. Container 4 may then be sealed by an adhesive which secures flaps 12 onto flap 13 or by placing a strip of tape (not shown) over the adjoining edges 21 of side flaps 12 along the center line. Other closure means are, of course, within the contemplation of the invention.

The container assembly 3 further includes at least one insert 5 which is placed at the top of the container 4. In the preferred embodiment as shown, container 4 is designed to receive two adjacent rows of bags 2, such that only a single insert 5 is needed. However, if container 4 is sized to receive additional rows of bags 2, additional inserts 5 may be incorporated into container 4, with each insert 5 being seated between adjacent rows of bags 2.

Figure 2:
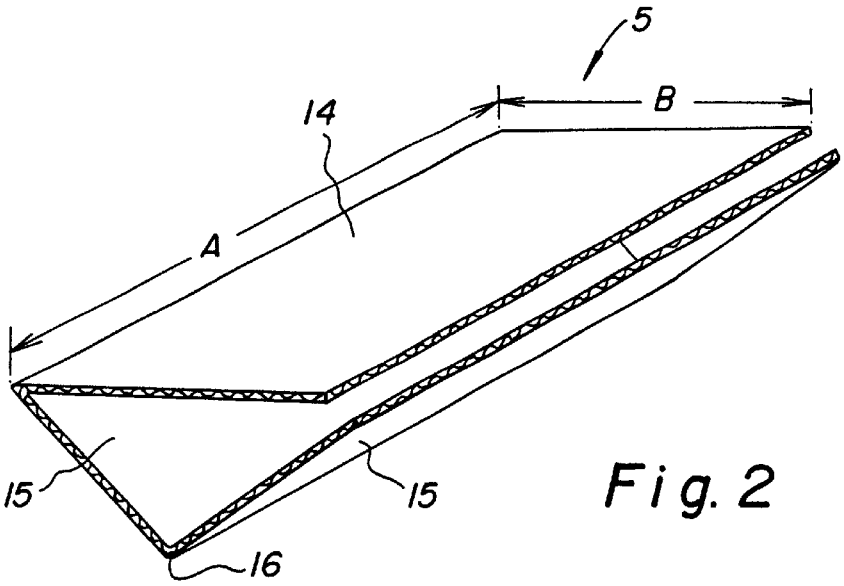
FIG. 2 is a perspective view of the insert of FIG. 1.

Insert 5 should be sufficiently rigid to maintain its shape. A solid block of any material, e.g., a lightweight Styrofoam material. However, in a preferred embodiment, insert 5 is formed from a single rectangular sheet of material such as corrugated cardboard. As shown in FIG. 2, the preferred shape of insert 5 is triangular such that a single piece of cardboard is pre-folded along two lines to form an apex 16, a base 14 and two side walls 15, with the side walls 15 being of substantially the same dimensions. It is also possible to fold the rectangular sheet only once and thereby form an apex 16 and two side walls 15, eliminating base 14 such that a V-shape, instead of a triangular shape, is formed. However, this structure is less desirable, as base 14 tends to keep side walls 15 from collapsing inwardly in the container 4 as headspace 17 in the bags 2 expands. Width B of the base 14 is substantially the same as the width of end walls 9 and length A of the base 14 is approximately the same as that of side walls 8 such that the open top 10 of the container 4 is substantially completely covered.

FIG. 3 shows the packaging system 1 before insert 5 has been placed in container 4 and before gases have expanded the headspace 17 in the bags 2. At this time, referring also to FIG. 4, the product 19 within the bags 2 does not come up to the top of the bag 2. Rather, it leaves a headspace 17 above the product. Referring to FIG. 3, the top portion of container 4 is much larger than the room now taken up by the tops of bags 2 at their headspaces 17. Without the insert 5, gas generation in the bags prior to venting through valves 6 could cause the headspaces of bags 2 to swell and fill much of the space at the top of the container as shown in the extreme in FIG. 5. A certain amount of gas is desirable in headspaces 17 as the gas contains the aroma which is released upon opening the bags 2. However, as noted above, valves 6 are typically designed to allow headspace 17 to completely swell up before allowing any release of gases.

As shown in FIG. 4, insert 5 reduces the amount of space available at the top of the container 4 into which the headspaces 17 of bags 2 may expand. Maximum internal pressure in headspaces 17 is thereby reached before headspaces 17 actually become completely filled with gas so that valves 6 open to release the pressure and the bags 2 do not fully swell.

Besides preventing bags 2 from becoming swollen, insect 5 also protects bags 2 from being cut if container 4 is opened with a knife or other sharp object as is typically the case. As noted above, panels 12 of closure means 11 are typically sealed by adhesive to inside panels 13 or adjoining edges 21 are closed against panels 13 by a strip of tape extending between opposite end walls 9. Because insert 5 also reduces the available space at the top of container 4, it also reduces movement of bags 2 in container 4 which helps to prevent damage to bags 2 such as cracks and holes which can occur when bag packages are moved about within the container 4 during shipping and handling.

EXAMPLE

In order to test the effectiveness of the packaging system of the invention, container assemblies having bags of coffee contained therein were subjected to 40 minutes of ASTM Standard Loose Load vibration using different container orientations to simulate shipping conditions. Containers having coffee bags therein without an insert were tested using the same method to provide a standard of comparison. Before conducting the vibration testing, all coffee bags were examined to ensure that the valves were properly sealed. Only bags having 4% or less oxygen content in the headspace, considered as being of a good quality, were subject to vibration. The results of the testing is provided in the table below.

LEAKERS AFTER VIBRATION

| Container | Number and Percent Flex Cracks | | | |
|---|---|---|---|---|
| Orientation During Vibration | Normal Container (without insert) | | Container with insert | |
| Right side up | 4 out of 48 | 8% | 0 out of 48 | 0% |
| Upside down | 18 out of 18 | 100% | 21 out of 48 | 44% |
| Laying on face | 14 out of 24 | 58% | 0 out of 24 | 0% |

As can been seen from the results, the insert helped to substantially reduce pinholing and flex cracking in the bags, even in the unusual circumstance where the containers were turned upside down.

Although the invention has been described in considerable detail with respect to the preferred embodiments thereof, variations and modifications will be apparent to those skilled in the art without departing from the spirit and scope of the invention, as set forth in the claims.

What is claimed is:

1. A packaging system comprising in combination;

a container, a plurality of sealed bags arranged upright in the container and openable at their tops, and each of the bags containing roasted coffee, which, after initial closure of the bag, generates gases to increase the internal volume of the bag, each bag having a headspace between the top of the roasted coffee and the top of the bag, the top of each bag being generally collapsed prior to expansion by generated gases and enlarged after creation of generated gases, each bag further comprising a valve for venting generated gases after the pressure of the generated gases in the bag exceeds a certain pressure, said plurality of the bags arranged in rows in the container with the tops of the bags in the generally collapsed position with reduced headspaces, and an insert positioned in the container between the rows of bags, generally above the roasted coffee and against the tops of the bags and their corresponding reduced headspaces, sufficient to generally secure the bags against movement within the container and to prevent enlargement of the top of the bags and their corresponding headspaces by the generated gases, and such that, once the pressure in the bags exceeds the certain pressure, any further generated gases will be forced to vent out of the package through the valves rather than increase the size of the headspaces.

2. The packaging system according to claim 1, wherein the bags are arranged in the container in side by side rows, and the insert is elongated with a triangular cross section and positioned between the rows with a base uppermost and an apex lowermost.

3. The packaging system according to claim 2, wherein the container has a bottom wall, a pair of side walls and a pair of end walls shorter than the side walls, and including two said rows extending one along each side wall, and the triangular insert is positioned between the rows to urge the tops of the bags downwardly and outwardly toward said side walls.

4. The packaging system according to claim 1, wherein said insert is removable.

5. The packaging system according to claim 4, wherein said insert comprises at least two panels forming a V-shape.

6. The packaging system according to claim 5, wherein said insert comprises three panels forming a triangular shape.

7. The packaging system according to claim 6, wherein said insert comprises a rectangular sheet of material having two parallel fold lines for forming said triangular shape.

8. The packaging system according to claim 1 wherein said container comprises a rectangular shaped box.

* * * * *